US007028768B2

(12) United States Patent
Aler et al.

(10) Patent No.: US 7,028,768 B2
(45) Date of Patent: Apr. 18, 2006

(54) FLUID HEAT EXCHANGE CONTROL SYSTEM

(75) Inventors: Mark Dennis Aler, Skokie, IL (US); James Jin-Hao Gu, Wheeling, IL (US); Karen Jo Sanchez, Chicago, IL (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 239 days.

(21) Appl. No.: 10/644,307

(22) Filed: Aug. 20, 2003

(65) Prior Publication Data

US 2005/0039904 A1 Feb. 24, 2005

(51) Int. Cl.
*F25D 17/02* (2006.01)

(52) U.S. Cl. ..... 165/219; 165/205; 165/101; 165/283; 165/246; 62/185; 62/201; 62/175; 62/435; 62/99

(58) Field of Classification Search ..... 165/219, 165/205, 218, 101, 283, 246; 62/185, 201, 62/175, 435, 99
See application file for complete search history.

(56) References Cited

U.S. PATENT DOCUMENTS 2,935,857 A * 5/1960 McFarlan ..... 62/159
3,176,759 A * 4/1965 Windham ..... 165/220
3,202,208 A * 8/1965 Geiringer ..... 165/219
3,729,051 A * 4/1973 Mannion et al. ..... 165/246
4,120,033 A * 10/1978 Corso et al. ..... 702/47
4,210,957 A * 7/1980 Spethmann ..... 700/276
4,463,574 A * 8/1984 Spethmann et al. ..... 62/175
4,483,152 A * 11/1984 Bitondo ..... 62/175
4,492,091 A 1/1985 Whitwell et al.
4,603,556 A 8/1986 Suefuji et al.
5,056,712 A 10/1991 Enck
5,070,704 A * 12/1991 Conry ..... 62/175
5,090,872 A 2/1992 Kuwabara et al.
5,138,845 A * 8/1992 Mannion et al. ..... 62/99
5,170,936 A 12/1992 Kubo et al.
5,190,215 A 3/1993 Habermehl, Jr. et al.
5,195,329 A * 3/1993 Lewis et al. ..... 62/117
5,248,084 A 9/1993 Latarius
5,301,513 A * 4/1994 Duff et al. ..... 62/117

(Continued)

FOREIGN PATENT DOCUMENTS

EP 1113231 A2 7/2001

*Primary Examiner*—John K. Ford
(74) *Attorney, Agent, or Firm*—RatnerPrestia

(57) ABSTRACT

A method of controlling a hydronic system is provided. The hydronic system includes a plurality of fluid heat exchange units for feeding a load, and a bypass valve for bypassing the load. The method includes operating at least a first and a second fluid heat exchange unit in the hydronic system to heat or cool a fluid. An output fluid flow of each of the operating fluid heat exchange units is monitored. The monitored output fluid flow of each fluid heat exchange unit is compared to a predetermined fluid flow setpoint. The output fluid flow of each of the operating fluid heat exchange units is adjusted towards the predetermined fluid flow setpoint if the monitored output flow is different from the predetermined fluid flow setpoint by at least a predetermined margin. A combined output fluid flow of the operating fluid heat exchange units is also monitored. The bypass valve is at least partially opened if the combined output fluid flow is below a predetermined minimum combined output fluid flow. A previously idle fluid heat exchange unit is operated if the combined output fluid flow is greater than a predetermined maximum combined output fluid flow for the number of operating fluid heat exchange units.

9 Claims, 4 Drawing Sheets

U.S. PATENT DOCUMENTS 5,309,727 A * 5/1994 Duff et al. ..... 62/117
5,316,384 A * 5/1994 Corso ..... 366/338
5,318,106 A * 6/1994 Dorini et al. ..... 165/292
5,425,503 A * 6/1995 Corso ..... 237/63
5,448,895 A 9/1995 Coellner et al.
5,491,982 A 2/1996 Gowens
5,540,555 A * 7/1996 Corso et al. ..... 417/44.2
5,551,249 A 9/1996 Van Steenburgh, Jr.
5,605,053 A 2/1997 Otori
5,626,287 A 5/1997 Krause et al.
5,707,221 A 1/1998 Wittrisch
5,910,158 A 6/1999 Park
5,946,926 A * 9/1999 Hartman ..... 62/201
6,018,959 A 2/2000 Schmidt
6,176,306 B1 1/2001 Gault
6,212,894 B1 4/2001 Brown et al.
6,220,043 B1 4/2001 Chaney, Jr. et al.
6,293,757 B1 9/2001 Oda et al.
6,311,504 B1 11/2001 Yamazaki et al.
6,390,780 B1 5/2002 Batchelder et al.
6,449,969 B1 * 9/2002 Fujimoto et al. ..... 62/180
6,666,042 B1 * 12/2003 Cline et al. ..... 62/175
2003/0037919 A1 * 2/2003 Okada et al. ..... 165/206
2004/0026075 A1 * 2/2004 Park et al. ..... 165/218

* cited by examiner

FLUID HEAT EXCHANGE CONTROL SYSTEM

FIELD OF THE INVENTION

This invention relates to a control system for controlling a fluid heat exchange system, and more particularly, to a control system for controlling a fluid heat exchange system based upon predetermined criteria.

BACKGROUND OF THE INVENTION

In existing hydronic systems it is often desirable to provide a number of pieces of equipment of the same type, or of a similar type. For example, such equipment may include water pumps, water chillers, and associated heat exchange units. By supplying a hydronic system with such repetitive or redundant equipment, a system capable of providing for varying demand, or for accommodating for maintenance of the equipment, is provided.

However, such hydronic systems often suffer from a number of deficiencies. For example, such systems may include equipment such as decoupling piping and distribution flow loop pumps. These pieces of equipment are typically utilized in order to provide for isolation, and to provide an approximately constant flow volume to be used by heat transfer devices in the hydronic system, such as chillers and boilers. However, the inclusion of this equipment results in additional equipment and maintenance costs.

As such, it would be desirable to provide a hydronic system without such equipment, while providing for equipment isolation, and while providing a desired flow rate.

SUMMARY OF THE INVENTION

In an exemplary embodiment of the present invention, a method of controlling a hydronic system is provided. The hydronic system includes a plurality of fluid heat exchange units for feeding a load, and a bypass valve for bypassing fluid flow from the load. The method includes operating at least a first and a second fluid heat exchange unit in the hydronic system to heat or cool a fluid. An output fluid flow of each of the operating fluid heat exchange units is monitored. The monitored output fluid flow of each fluid heat exchange unit is compared to a predetermined fluid flow setpoint. The output fluid flow of each of the operating fluid heat exchange units is adjusted towards the predetermined fluid flow setpoint if the monitored output flow is different from the predetermined fluid flow setpoint by at least a predetermined margin. A combined output fluid flow of the operating fluid heat exchange units is also monitored. The bypass valve is at least partially opened if the combined output fluid flow is below a predetermined minimum combined output fluid flow. A previously idle fluid heat exchange unit is operated if the combined output fluid flow is greater than a predetermined maximum combined output fluid flow for the number of operating fluid heat exchange units.

In another exemplary embodiment of the present invention, a hydronic system is provided. The hydronic system includes a plurality of fluid heat exchange units including at least a first and a second fluid heat exchange unit for feeding a load. The hydronic system also includes a bypass valve for bypassing fluid flow from the load. A plurality of fluid flow monitors monitor an output fluid flow of a respective fluid heat exchange unit. A combination flow monitor monitors a combined output fluid flow of the fluid heat exchange units. The hydronic system also includes a control system. The control system compares the monitored output fluid flow of each fluid heat exchange unit to a respective predetermined fluid flow setpoint. The control system adjusts the output fluid flow of each of the operating fluid heat exchange units towards the predetermined fluid flow setpoint if the monitored output flow is different from the predetermined fluid flow setpoint by at least a predetermined margin. The control system also provides a command to the bypass valve to at least partially open if the combined output fluid flow is below a predetermined minimum combined output fluid flow. Further, the control system provides a request to operate a previously idle fluid heat exchange unit if the combined output fluid flow is greater than a predetermined maximum combined output fluid flow for the number of operating fluid heat exchange units.

BRIEF DESCRIPTION OF THE DRAWINGS

Exemplary embodiments of the invention will be described with reference to the drawings, of which.

DETAILED DESCRIPTION OF THE INVENTION

Preferred features of selected embodiments of this invention will now be described with reference to the figures. It will be appreciated that the spirit and scope of the invention is not limited to the embodiments selected for illustration. Also, it should be noted that the drawings are not rendered to any particular scale or proportion. It is contemplated that any of the configurations and materials described hereafter can be modified within the scope of this invention.

As described herein, fluid heat exchange units are provided to heat or cool a fluid. For example, chillers and boilers are exemplary types of fluid heat exchange units. In certain exemplary embodiments of the present invention (as described herein), a load fed by the fluid heat exchange units includes fluid to air heat exchange units (i.e., air handling units), whereby air used to heat or cool an area is heated or cooled using fluid from one or more fluid heat exchange units (e.g., chillers).

Figure 1:
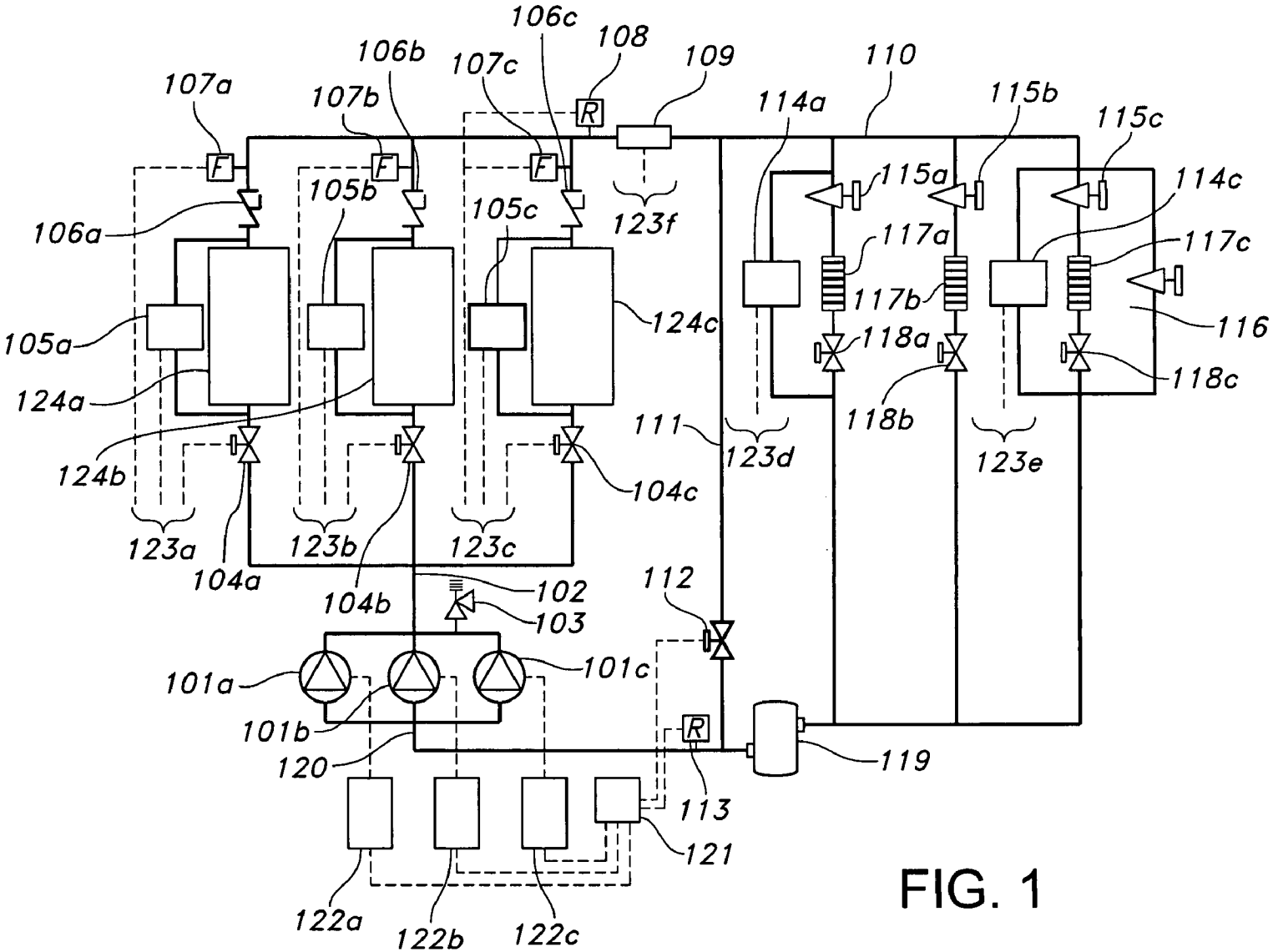
FIG. 1 is a process flow diagram in accordance with an exemplary embodiment of the present invention.

FIG. 1 illustrates a variable speed pumping system in accordance with an exemplary embodiment of the present invention. For example, the system illustrated in FIG. 1 is a 3-chiller (i.e., 3-fluid heat exchange unit), 3-pump, and 2-zone system.

Generally speaking, adjustable frequency drives 122*a*, 122*b*, and 122*c*, through signals received by controller 121, control the speed of pumps 101*a*, 101*b*, and 101*c*. Pumps 101*a*, 101*b*, and 101*c* feed a fluid. (e.g., water) to header 102, and the fluid is then fed to fluid heat exchange units 124*a*, 124*b*, and 124*c* (e.g., chillers 124*a*, 124*b*, and 124*c*). Chillers 124*a*, 124*b*, and 124*c* chill the fluid and then feed the chilled fluid to header 110. The fluid if fed from header 110 to load units 117*a*, 117*b*, and 117*c* (e.g., air handling units 117*a*, 117*b*, and 117*c*). The chilled fluid from header 110 provides heat exchange with air handling units 117*a*,

117*b*, and 117*c*, and as such, air handling units 117*a*, 117*b*, and 117*c* can provide cool air as desired. After providing the desired heat exchange with air handling units 117*a*, 117*b*, and 117*c*, the fluid returns to pumps 101*a*, 101*b*, and 101*c* through header 120. As detailed herein, bypass valve 112 may be opened, closed, or partially opened, as desired, to adjust the flow of the fluid through the hydronic system.

When the variable speed pumping system illustrated in FIG. 1 is initially started, it may be operated manually; however, at some point during operation it may be desirable to switch into an automatic mode. In the automatic mode it is preferred that at least one of the lead chiller isolation valves 104*a*, 104*b*, and 104*c* is open, and at least one of the lead pumps 101*a*, 101*b*, and 101*c* is running, even when the corresponding chiller(s) 124*a*, 124*b*, and 124*c* are offline. When there is a call/request to the system for chilled water, at least one of the chillers 124*a*, 124*b*, and 124*c* will start. Pump(s) 101*a*, 101*b*, and 101*c* supply flow through the discharge header piping 102. In the event that the pump(s) 101*a*, 101*b*, and 101*c* operate with closed valves (i.e., lead chiller isolation valves 104*a*, 104*b*, and 104*c*), pressure relief valve 103 will open to protect the pump(s) 101*a*, 101*b*, and 101*c*. During normal operation, flow continues past open isolation valve(s) 104*a*, 104*b*, and 104*c* and into respective chillers 124*a*, 124*b*, and 124*c* where the desired heat transfer may be accomplished.

The flow through chiller(s) 124*a*, 124*b*, and 124*c* can be determined in any of a number of ways. For example, the flow may be determined indirectly using a signal from respective differential pressure transmitters 105*a*, 105*b*, and 105*c*. Alternatively (or in addition to having information from the differential pressure transmitters), the flow may be determined directly by using respective flow transmitters 107*a*, 107*b*, and 107*c*.

Signals from each of differential pressure transmitters 105*a*, 105*b*, and 105*c*, flow transmitters 107*a*, 107*b*, and 107*c*, and lead chiller isolation valves 104*a*, 104*b*, and 104*c* are sent to a control system (e.g., including controller 121) in signal groups 123*a*, 123*b*, and 123*c*, as shown in FIG. 1.

Check valves 106*a*, 106*b*, and 106*c* at the discharge of each chiller 124*a*, 124*b*, and 124*c* prevent flow from short-circuiting around any of chillers 124*a*, 124*b*, and 124*c* that are not operating. The output flow from each of chillers 124*a*, 124*b*, and 124*c* are brought together in chilled water supply header 110. The temperature and flow in chilled water supply header 110 can be measured, for example, using temperature transmitter 108 and flow meter 109. Signals from temperature transmitter 108 may be sent to the control system as part of signal group 123*c*, and signals from flow meter 109 may be sent to the control system as signal 123*f*.

Flow proceeds from chilled water supply header 110 to the load of the chillers (i.e., air handling units 117*a*, 117*b*, and 117*c*), or through bypass line 111. The flow that proceeds to each of air handling units 117*a*, 117*b*, and 117*c* first passes through a corresponding balance valves 115*a*, 115*b*, or 115*c* for the respective circuit.

For example, each of air handling units 117*a*, 117*b*, and 117*c* may contain an internal control valve (not shown) that is modulated in direct proportion to the signal from a room thermostat. Each of air handling units 117*a*, 117*b*, and 117*c* can be isolated from the system (e.g., for maintenance) using respective zone isolation valve 118*a*, 118*b*, and 118*c*. Balance valve 116 is installed at the end of the system to reduce thermal stagnation during periods of low flow, and to provide minimum flow through the pump. For example, if the hydronic system illustrated in FIG. 1 had periods of extended light load (e.g., weekend shutdowns), balance valve 116 may be set for low flow to reduce thermal stratification and to allow for a quick start up after shutdown.

The flow from each of air handling units 117*a*, 117*b*, and 117*c* is combined at air elimination device 119. Since the system is a closed loop, air elimination device 119 may be provided to eliminate or substantially reduce air trapped in the closed loop. After leaving air elimination device 119, the flow continues through chilled water return header 120. If desired, the temperature of the return water may measured (for use by the control system) by temperature transmitter 113 installed in chilled water return header 120. The water then returns to pumps 101*a*, 101*b*, and 101*c* to complete the circuit again.

The speed of each of pumps 101*a*, 101*b*, and 101*c* may be controlled by a respective adjustable frequency drive 122*a*, 122*b*, and 122*c*. The operational state (i.e., online, offline, etc.) and the speed of each of pumps 101*a*, 101*b*, and 101*c* is determined by controller 121.

In order to provide efficient control of the heat exchange system, a number of guidelines and priorities are considered by the control system, including controller 121.

One priority of controller 121 is to monitor the flow through each of chillers 124*a*, 124*b*, and 124*c*, for example, by monitoring the output of zone differential pressure sensors 114*a* and 114*c* that are sent to controller 121 as signals 123*d* and 123*e* (although contemplated in certain embodiments of the present invention, no zone differential pressure sensor 114*b* is shown in FIG. 1 across air handling unit 117*b*). The output of zone differential pressure sensors 114*a* and 114*c* are then compared to set points stored in (or accessible by) controller 121. The speed of each of pumps 101*a*, 101*b*, and 101*c* is modulated by a respective one of adjustable frequency drives 122*a*, 122*b*, and 122*c* to maintain or approximate the set point. Pump staging may occur in order to reach the set point.

Another priority of controller 121 is to determine if the minimum flow set points or requirements are being met for each of running chillers 124*a*, 124*b*, and 124*c*. If the flow through any of chillers 124*a*, 124*b*, and 124*c* is not high enough, the bypass valve 112 may be opened to increase the flow through chillers 124*a*, 124*b*, and 124*c*. By ensuring that adequate flow is provided through each of the operating chillers, freeze-up of the chillers may be substantially reduced or prevented.

Temperature transmitters 108 and 113 may be provided to monitor the supply and return water temperature in the loop. If it is determined that bypass valve 112 should be opened (e.g., to increase the flow through the operating chillers), the current return water temperature will be recorded to memory. Once bypass valve 112 is opened the return water temperature will continue to be monitored. When the return water temperature increases to the return water temperature prior to opening bypass valve 112, bypass valve 112 may then be closed.

If the initial opening of bypass valve 112 is not sufficient to supply the minimum flow, bypass valve 112 will be opened by an additional step value defined in the user setup of the control system. This iterative process may be continued until both the zone and chiller flow requirements are satisfied.

Yet another priority of controller 121 is to monitor the entire system flow rate to prevent operation above the maximum flow for both the chillers (124*a*, 124*b*, and 124*c*) and the pumps (110*a*, 101*b*, and 101*c*). Maximum chiller flow may be determined by totaling the maximum flow setpoints or requirements for each of operating chillers

124*a*, 124*b*, and 124*c*. When the system flow as determined by flow transmitter 109 exceeds the maximum flow rate that the operating chillers (some combination of 124*a*, 124*b*, and 124*c*) are designed to handle, controller 121 may send out a signal to request that the next chiller (124*a*, 124*b*, and 124*c*) in sequence be turned on. By substantially preventing operation of the chillers above a desired maximum flow, chiller tube erosion may be substantially reduced or prevented.

According to the exemplary embodiment of the present invention illustrated in FIG. 1, various signal inputs are received by controller 121, and various signals are output from controller 121. These input and output signals may be either analog or digital, based on the controller and external devices utilized, and user preference. For example, output signals may include, amongst other signals, (a) speed for each of the adjustable frequency drives (122*a*, 122*b*, and 122*c*), (b) control of bypass valve 112, (c) operation and control of chiller isolation valves (104*a*, 104*b*, and 104*c*), (d) request to stage/de-stage chillers (command, indication, alarm, etc.), (e) on/off commands for adjustable frequency drives (122*a*, 122*b*, and 122*c*), etc. Further, input signals may include, amongst other signals, (a) chiller differential pressure signals from transmitters (105*a*, 105*b*, and 105*c*), (b) flow signals from flow sensors/transmitters 107*a*, 107*b*, and 107*c*, (c) zone differential pressure signals from sensors 114*a* and 114*c*, (d) system flow signal from flow meter 109, (e) bypass valve feedback signal, (f) supply temperature signal 108, (g) return temperature signal 113, (h) local/remote control switch for chillers, pumps and air handling units, (i) adjustable frequency drive indication signals (122*a*, 122*b*, and 122*c*), (j) pump differential pressure signals, (k) isolation valve position signals, (l) alarm satisfied/silence signals, and (m) chiller start/stop command/operational state indication.

The operational sequence of various embodiments of the present invention will now be described with respect to FIG. 1. In the manual mode, an operator controls the number of pumps (101*a*, 101*b*, and 101*c*), speed of the drive(s) (122*a*, 122*b*, and 122*c*), and operation of bypass valve 112. A signal to the chiller isolation valves (104*a*, 104*b*, and 104*c*) will automatically open the valve to provide system flow when the pump is started in manual.

Before proceeding, a determination or verification (either automatically or with human intervention) is conducted indicating that no alarms or requests to stage or de-stage chillers are present. As a safety, it may be assumed that an operator will run the pumps at a speed higher than required, and as such, control is switched to an automatic mode. When a user switches from manual to automatic mode a confirmation screen will be provided to ask the user to confirm the request. Once the request is confirmed three control priorities, as defined below, will determine much of the system control. Signals controlling drive speed signal and valve position may be started from the values previously defined in manual operation. To eliminate rate of change issues the PID output can be buffered during the manual mode to automatic mode transition by a factor defined in the setup menu.

In the automatic mode, the lead chiller isolation valve (104*a*, 104*b*, or 104*c*) may be kept open and the lead pump (101*a*, 101*b*, or 101*c*) may be kept running, even when the lead chiller (124*a*, 124*b*, or 124*c*) is offline. In the event that the lead chiller (124*a*, 124*b*, or 124*c*) is offline, bypass valve 112 may be opened to a minimum initial opening as defined in the user set up. The flow through bypass 112 will protect the pumps (101*a*, 101*b*, and 101*c*) from operating at dead-head pressures in the event that all of the control valves are closed.

Upon receiving a chiller start input signal from chiller 124*b* or chiller 124*c* (assuming that chiller 124*a* is the lead chiller), the next pump (101*a*, 101*b*, or 101*c*) in the system operational sequence will start and the isolation valves (e.g., 104*b*, 104*c*) for the next chiller (124*b* or 124*c*) in sequence will open.

If differential pressure sensors 105*a*, 105*b*, and 105*c* are installed across the respective chillers as shown in FIG. 1, controller 121 may be configured to ensure that each chiller (124*a*, 124*b*, and 124*c*) is in proper working condition by monitoring each operating chiller's differential pressure. The flow through chillers 124*a*, 124*b*, and 124*c* is calculated using flow values defined in the user setup.

If flow sensors 107*a*, 107*b*, and 107*c* are installed at each chiller as shown in FIG. 1, controller 121 may be configured to ensure that each chiller (124*a*, 124*b*, and 124*c*) is in proper working condition by monitoring each operating chiller's flow rate.

As provided above, a priority (sometimes referred to as the first priority) of control system according to the present invention is that controller 121 monitors zone differential pressure sensors (e.g., 114*a*, 114*c*) and compares actual process values with the set points stored within the control system. The pump speed may be modulated to maintain or approximate the set point. Pump staging may occur to meet or approximate the set point.

As provided above, another priority (sometimes referred to as the second priority) of the control system is to determine if the minimum flow requirements are being met for all operating chillers (124*a*, 124*b*, and 124*c*). This priority may be accomplished through single or multiple chiller control.

In single chiller control mode, the adjustable frequency drive speed is monitored to supply minimum flow for each chiller. For example, in this mode, the inputs provided to the control system include (a) chiller running input signal (lead chiller), and (b) minimum adjustable frequency drive speed declared for the operating chiller in the setup menu.

As a safety, the minimum flow requirements of the operating chiller may be monitored. This may be accomplished by monitoring the flow signal (from transmitter 107*a*, 107*b*, or 107*c*) or the differential pressure signal (from sensor 105*a*, 105*b*, or 105*c*). For example, in this mode, the inputs provided to the control system include (a) whichever flow signal for the lead chiller is available, and (b) the minimum flow declared for the operating chiller in the setup menu. If the speed signal, actual flow, or differential pressure signal indicates that flow is not high enough bypass valve 112 may be opened to a user (or system) defined initial opening value. Additionally, the minimum flow, differential pressure or speed set points may be increased by a user defined factor to ensure proper chiller operation and to avoid nuisance alarms.

When bypass valve 112 is opened the PID loop may be frozen to allow the system to react to the new valve position. After a time delay the pump (101*a*, 101*b*, or 101*c*) speed will modulate to maintain control as defined under the first priority discussed above. After the system stabilizes the adjustable frequency drive speed may be saved to the control system memory. When the adjustable frequency drive speed is increased by a predetermined percentage, valve 112 will be closed by a user (or system) defined step value to minimize the operating speed of the primary pump (101*a*, 101*b*, or 101*c*).

As a safety, the supply and return water temperature may be monitored (e.g., by RTDs such as transmitters 108 and 113) as part of a system BTU optimization. When it is determined that bypass valve 112 should be opened the current return temperature may be recorded to the control system memory. Once valve 112 is opened the return temperature may continue to be monitored. When the return temperature increases to the temperature that it was at prior to opening valve 112 it may be assumed that bypass valve 112 can be closed by the next predetermined step value.

If the initial opening of bypass valve 112 is not sufficient to supply minimum flow, valve 112 may be opened by the additional predetermined step value defined in the user setup. This iterative process may be continued until both the zone flow and chiller flow set points are satisfied.

In contrast to the single chiller control mode described above, in the multiple chiller control mode the desired minimum flow requirements for all operating chillers are combined. For example, in this mode the inputs provided to the control system include (a) the chiller running status input signals from each chiller, and (b) the desired minimum flow declared for each chiller in the setup menu. If the total combined flow is less than the calculated minimum flow for the operating chillers, bypass valve 112 may be opened by a user (or system) defined step value. For example, the minimum flow requirement may be increased by a user defined factor to ensure proper chiller operation and to avoid nuisance alarms.

When bypass valve 112 is opened the PID loop is frozen to allow the system to react to the new valve position. After a time delay the pump speed will modulate to maintain control as defined under the first priority. After the system stabilizes the adjustable frequency drive speed will be saved to the control system memory. When the adjustable frequency drive speed is increased by a predetermined percentage, valve 112 will be closed by a user/system defined step value to minimize the operating speed of the primary pump (e.g., pump 101*a*).

If the initial opening of valve 112 is not sufficient to supply the desired minimum flow, valve 112 will be opened by an additional step value, for example, a predetermined step value defined in the user setup. This iterative process will continue until both the zone flow and chiller flow preferences are satisfied.

When bypass valve 112 is opened, a visual alarm/indication (e.g., a light, an LED, etc.) may be provided to indicate that it may be time to de-stage a chiller (124*a*, 124*b*, or 124*c*). This indication may also be used to advise a user of valve 112 opening, thereby aiding them in the decision as to whether to de-stage a chiller.

If the minimum desired flow can not be met when the drive(s) (122*a*, 122*b*, and/or 122*c*) is (are) operating at full speed or when bypass valve 112 is fully open, then controller 121 may send out an output signal to request that a lag chiller in sequence be turned offline. A visual alarm may light/operate, and an audible alarm may sound, both indicating the status. For example, the display may advise that bypass valve 112 is fully opened or that the adjustable frequency drive (122*a*, 122*b*, or 122*c*) is at full speed and still minimum flow can not be met.

Controller 121 may provide each pump (101*a*, 101*b*, and 101*c*) with an off delay when a chiller is de-staged or turned offline to prevent freezing. When a chiller "start" and a chiller "running" input signal are turned off and a user/system defined time delay has expired, chiller isolation valve (104*a*, 104*b*, or 104*c*) will close and the corresponding pump (101*a*, 101*b*, or 101*c*) will continue to operate. The display may indicate that isolation valve (104*a*, 104*b*, or 104*c*) is now closed. Pump (101*a*, 101*b*, or 101*c*) will continue running until the process variable, end, and/or curve de-staging logic determines it is time to turn off the pump (101*a*, 101*b*, or 101*c*).

As provided above, yet another priority (sometimes referred to as the third priority) of the control system is to monitor the system flow rate to prevent operation above the maximum flow for chillers 124*a*, 124*b*, and 124*c* and pumps 101*a*, 101*b*, and 101*c*.

The maximum desired chiller flow is determined by combining the maximum flow setpoints for each of the operating chillers (124*a*, 124*b*, and 124*c*). For example, input signals used for this function may include (a) the chiller running/operational status input signal from each chiller (124*a*, 124*b*, and 124*c*), and (b) the maximum desirable flow declared for each chiller (124*a*, 124*b*, and 124*c*) in the setup menu. When the system flow exceeds the maximum flow rate that the combined flow operating chillers desirably handle, controller 121 may send out an output signal to request that the next chiller in sequence be turned online. A "request to stage" chiller light or indicator may be activated, and an audible alarm may sound. The display may indicate that the maximum system flow has been exceeded, and/or that it is time to turn on another of chillers 124*a*, 124*b*, and 124*c*.

The maximum desired pump flow is determined by combining the maximum flow setpoints for each of the operating pumps (101*a*, 101*b*, and 101*c*). Controller 121 may determine which of pumps 101*a*, 101*b*, and 101*c* are running, and may use the maximum desired flow declared for each pump in the setup menu to determine the end of curve flow stage point.

In the exemplary embodiment of the present invention illustrated in FIG. 1 (as well as the exemplary embodiments illustrated in FIGS. 2–3), various pieces of information may be displayed to a system user/operator. For example, (a) primary chiller operational status, primary pump operational status, chiller start signal status (i.e., on/off), chiller running signal status (on/off), pump status (i.e., on/off/fail), chiller isolation valve status (on/off/fail), bypass valve position (% open), supply water temperature, return water temperature, and current load (i.e., BTU/HR).

Figure 2:
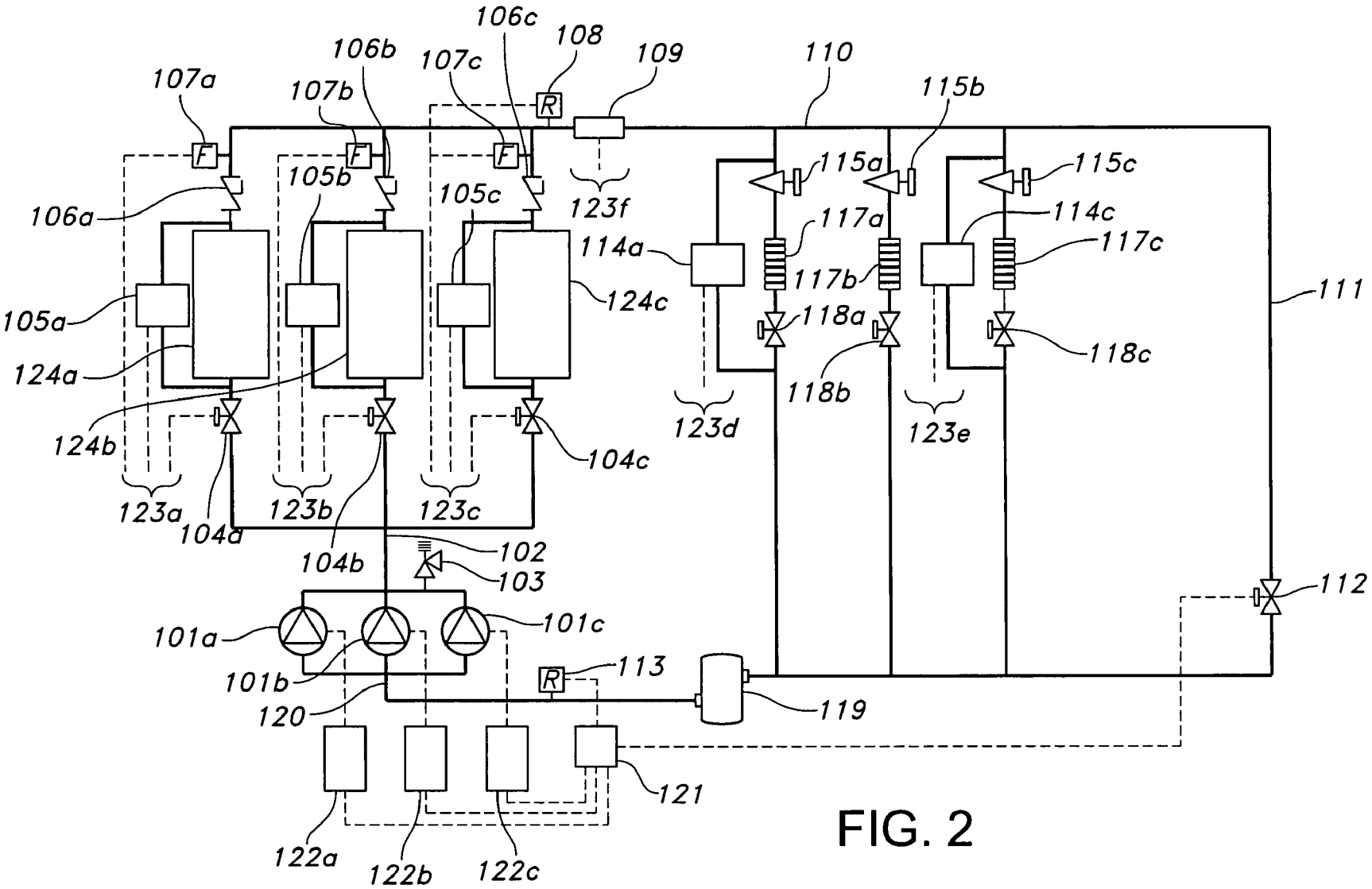
FIG. 2 is another process flow diagram in accordance with another exemplary embodiment of the present invention.

FIG. 2 illustrates a variable speed pumping system in accordance with another exemplary embodiment of the present invention. For example, the system illustrated in FIG. 2 is a 3-chiller, 3-pump and 2-zone system. The system illustrated in FIG. 2 is very similar to the system illustrated and described above with respect to FIG. 1. As such, like reference numerals refer to similar portions of the system, having similar functionality.

As opposed to the configuration of FIG. 1, the system illustrated in FIG. 2 includes bypass valve 112 at end of system. Operational sequence differences of the system illustrated in FIG. 2, as opposed to the system illustrated in FIG. 1, are highlighted below.

As with the system illustrated in FIG. 1, when the system illustrated in FIG. 2 is in the automatic mode, it may be desirable that the lead chiller isolation valves (104*a*, 104*b*, or 104*c*) are kept open and the lead pump (101*a*, 101*b*, or 101*c*) runs, even when the lead chiller (124*a*, 124*b*, or 124*c*) is offline. In contrast to the system of FIG. 1, bypass valve 112 illustrated in FIG. 2 will be opened by a predetermined amount as declared in the setup menu. This valve opening is provided in order to prevent stagnation of water in the remote zone.

As with the system illustrated in FIG. 1, in multiple chiller control mode, when the system illustrated in FIG. 2 senses that the combined flow is not high enough, bypass valve 112 may be opened to a user (or system) defined initial opening value. When bypass valve 112 is opened the PID loop is frozen to allow the system to react to the new valve position. After a time delay (e.g., a predetermined or hard coded time delay) the pump speed will modulate to maintain control as defined under the first priority. After the system stabilizes the adjustable frequency drive speed will be saved to the control system memory. When the adjustable frequency drive speed is increased by a predetermined percentage, valve 112 will be closed by a user/system defined step value to minimize the operating speed of the primary pump (e.g., pump 101*a*). However, in contrast to the system of FIG. 1, valve 112 in FIG. 2 will not fully close in order to prevent stagnation of water in the remote zone. Bypass valve 112 will remain open by the amount as declared in the setup menu.

Figure 3:
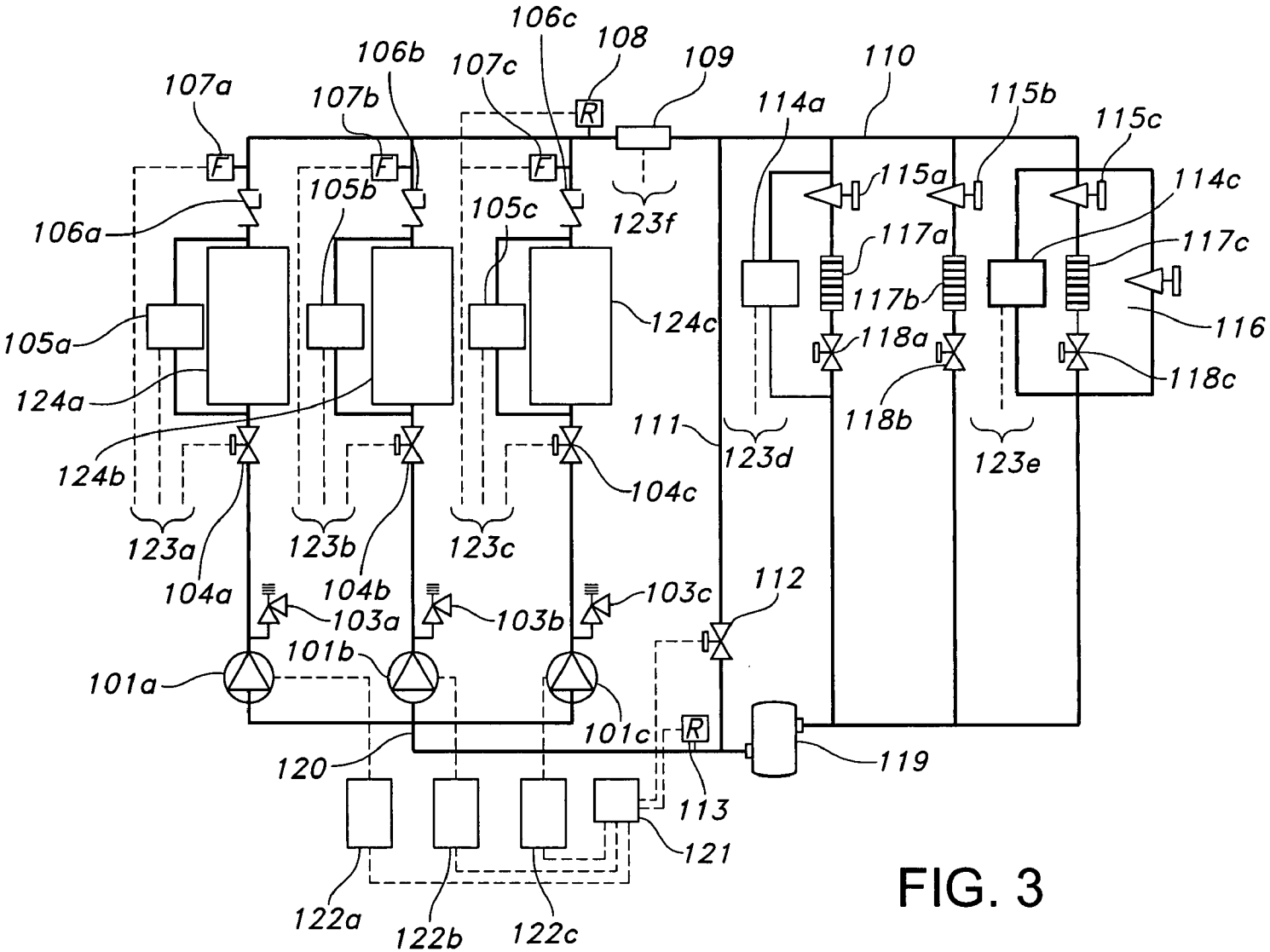
FIG. 3 is yet another process flow diagram in accordance with yet another exemplary embodiment of the present invention.

FIG. 3 illustrates a variable speed pumping system in accordance with another exemplary embodiment of the present invention. For example, the system illustrated in FIG. 3 is a 3-chiller, 3-pump and 2-zone system. The system illustrated in FIG. 3 is very similar to the system illustrated and described above with respect to FIG. 1. As such, like reference numerals refer to similar portions of the system having similar functionality.

As opposed to the configuration of FIG. 1, the system illustrated in FIG. 3 includes each of pumps 101*a*, 101*b*, and 101*c* piped directly to a respective chiller 124*a*, 124*b*, and 124*c*. Because of this configuration, each line from pump 101*a*, 101*b*, and 101*c* to chiller 124*a*, 124*b*, and 124*c* includes a separate pressure relief device 103*a*, 103*b*, and 103*c*. Operational sequence differences of the system illustrated in FIG. 3, as opposed to the system illustrated in FIG. 1, are highlighted below.

As provided above with respect to FIG. 1, a first priority of the control system according to the present invention is that controller 121 monitors zone differential pressure sensors (e.g., 114*a*, 114*c*) and compares actual process values with the set points stored within the control system. The pump speed may be modulated to maintain or approximate the set point. Controller 121 may send out a request/command signal to stage a lag chiller in order to meet the setpoint. However, in contrast to the system of FIG. 1, once the lag chiller (e.g., 124*b* or 124*c*) and pump (e.g., 101*b* or 101*c*) turns on, the pump (e.g., 101*a*) for the lead chiller (e.g., 124*a*) will be reduced in speed since both pump and chiller sets will now share the total load. The pumps will continue to operate at the same speed as load increases. Once the pumps increase in speed it may be desirable to operate the lead pump (e.g., 101*a*) at full speed to allow the chiller (e.g., 124*a*) to operate at a higher efficiency. The pump (e.g., 101*b* or 101*c*) for the lag chiller (e.g., 124*b* or 124*c*) will vary in speed to allow the lag chiller (e.g., 101*b* or 101*c*) to satisfy the current demand in response to the PID output. The transfer point where the lead pump(s) is/are locked at full speed may be defined in the user setup menu. The point where the pumps are released to share the load equally by operating at the same speed may also be defined in the user setup menu.

As provided above with respect to FIG. 1, as a safety in the single chiller control mode, the supply and return water temperature may be monitored (e.g., by RTDs such as transmitters 108 and 113) as part of a system BTU optimization. When it is determined that bypass valve 112 should be opened the current return temperature may be recorded to the control system memory. Once valve 112 is opened the return temperature may continue to be monitored. When the return temperature increases to the temperature that it was at prior to opening valve 112 it may be assumed that bypass valve 112 can be closed by the next predetermined step value. However, in contrast to the system of FIG. 1, when bypass valve 112 is opened a visual alarm/indication will indicate that it may be time to turn off the lag chiller (e.g., 124*b*). The display may also advise the user of bypass valve 112 opening, thereby aiding them in their decision with respect to turning off the lag chiller (e.g., 124*b*). Further, if the desired minimum flow can not be met when drive is operating at full speed or when bypass valve 112 is fully open, controller 121 may will send out a signal to request that the lag chiller (e.g., 124*b*) in sequence be turned off. A visual alarm will light/indicate the situation, and an audible alarm will sound. A display will advise that valve 112 is fully opened or that the respective adjustable frequency drive is at full speed, and that minimum desired flow can not be met.

Further, in the single chiller control mode, in the event that the lead pump (e.g., 101*a*) fails, the flow will fall below the minimum desired flow requirement. However, when the lead pump (e.g., 101*a*) fails, the associated chiller (e.g., 124*a*) is also out of service due to the piping configuration/layout of the embodiment of FIG. 3. In order to prevent a false alarm and time delay associated with the minimum flow logic, an alternate course of action is desired. As such, when a lead pump failure is detected controller 121 will immediately enable a request to stage the lag chiller as defined below.

With respect to multiple chiller control mode, an additional safety may be provided in the event that the optional differential pressure transmitters (105*a*, 105*b*, and 105*c*) or chiller flow transmitters (107*a*, 107*b*, and 107*c*) are not installed, controller 121 may calculate the expected flow from multiple chillers (combination of 124*a*, 124*b*, and 124*c*). To accomplish this, controller 121 may determine the value of the flow in the main chilled water supply line prior to starting a lag pump (e.g., 101*b*, 101*c*). The flow value from each chiller may then be calculated using pump affinity laws, particularly knowing the operating speed of each pump (101*a*, 101*b*, and 101*c*). If the actual flow through the main chilled water supply line is not equal to the calculated value within a user/system defined percentage, then a low flow alarm may be provided by controller 121. While this algorithm may be in effect continuously, it may offer the most protection when the speed of the lead pumps (e.g., 101*a*) are locked and the lag pump (e.g., 101*b*, 101*c*) is varying in speed. The area of concern is when the speed of the lag pump (e.g., 101*b*, 101*c*) may not be sufficient to keep its check valve pump (e.g., 106*b*, 106*c*) open. If check valve (e.g., 106*b*, 106*c*) closes the minimum flow value of the corresponding chiller will not be met. A data log in controller 121 may also keep track of the low flow alarm events in order to determine if there is an issue with the current user setup values.

As with the embodiment illustrated in FIG. 1, in multiple chiller control mode, the system illustrated in FIG. 3 provides for controller 121 providing each pump (101*a*, 101*b*, and 101*c*) with an off delay when the corresponding chiller (124*a*, 124*b*, and 124*c*) is de-staged or turned off to prevent freezing. However, in contrast to the system illustrated in FIG. 1, is when the chiller start and chiller running input signals are turned off and the user defined time delay has expired, chiller isolation valve (104*a*, 104*b*, and 104*c*) will close and the pump (101*a*, 101*b*, and 101*c*) will stop.

The system illustrated in FIG. 3 also includes the third priority described above with respect to FIG. 1, where the control system monitors the system flow rate to prevent operation above a maximum desired flow for the chillers and the pumps. In the embodiment illustrated in FIG. 3, with respect to the maximum desired chiller flow, this is determined by comparing the maximum desired flow limit for each of the operating chillers (124*a*, 124*b*, and 124*c*) with an actual maximum flow. For example, input signals used for this function may include (a) the chiller running/operational status input signal from each chiller (124*a*, 124*b*, and 124*c*), and (b) the maximum desirable flow declared for each chiller (124*a*, 124*b*, and 124*c*) in the setup menu. When the flow of a specific chiller exceeds the maximum desired flow rate that the specific chiller is desired to handle, controller 121 may send out an output signal to request that the next chiller in sequence be turned online. A "request to stage" chiller light/indication may be activated, and an audible alarm may sound. The display may indicate that the maximum system flow has been exceeded, and/or that it is time to turn on another of chillers 124*a*, 124*b*, and 124*c*.

In the embodiment illustrated in FIG. 3, an additional safety may be provided in the event that the optional differential pressure transmitters 105*a*, 105*b*, and 105*c* or chiller flow transmitters 107*a*, 107*b*, and 107*c* are not installed. In such a situation, controller 121 may calculate the expected flow from the multiple chillers. This may be accomplished, for example, by controller 121 determining the value of the flow in the main chilled water supply line and dividing the value by the number of running chillers. If the calculated flow per chiller is greater than a user/system defined maximum desired flow, then controller 121 may send out a signal to request that the next chiller in sequence be turned online. The "request to stage" chiller light/indication may be activated and an audible alarm may sound. Further still, the display may indicate that the maximum desired flow has been exceeded and that it is time to turn on another chiller.

Through the various embodiments disclosed herein, the present invention provides a hydronic system that can provide for isolation of desired equipment, while allowing for the elimination of certain other undesirable equipment. For example, de-coupling piping and/or distribution flow loop pumps may be eliminated according to various exemplary embodiments of the present invention. Because the present invention provides for proper control of modulating bypass valve 112, the desired flow in the production loop can be provided without the use of distribution flow loop pumps. As such, a more simple and cost-efficient hydronic system is provided.

Although the control features of the hydronic systems illustrated in FIGS. 1–3 have been described as three discrete embodiments, they are not limited thereto. Various features described in each of the embodiments may be applied to the alternative embodiments, and to non-illustrated embodiments within the scope of the invention.

Figure 4:
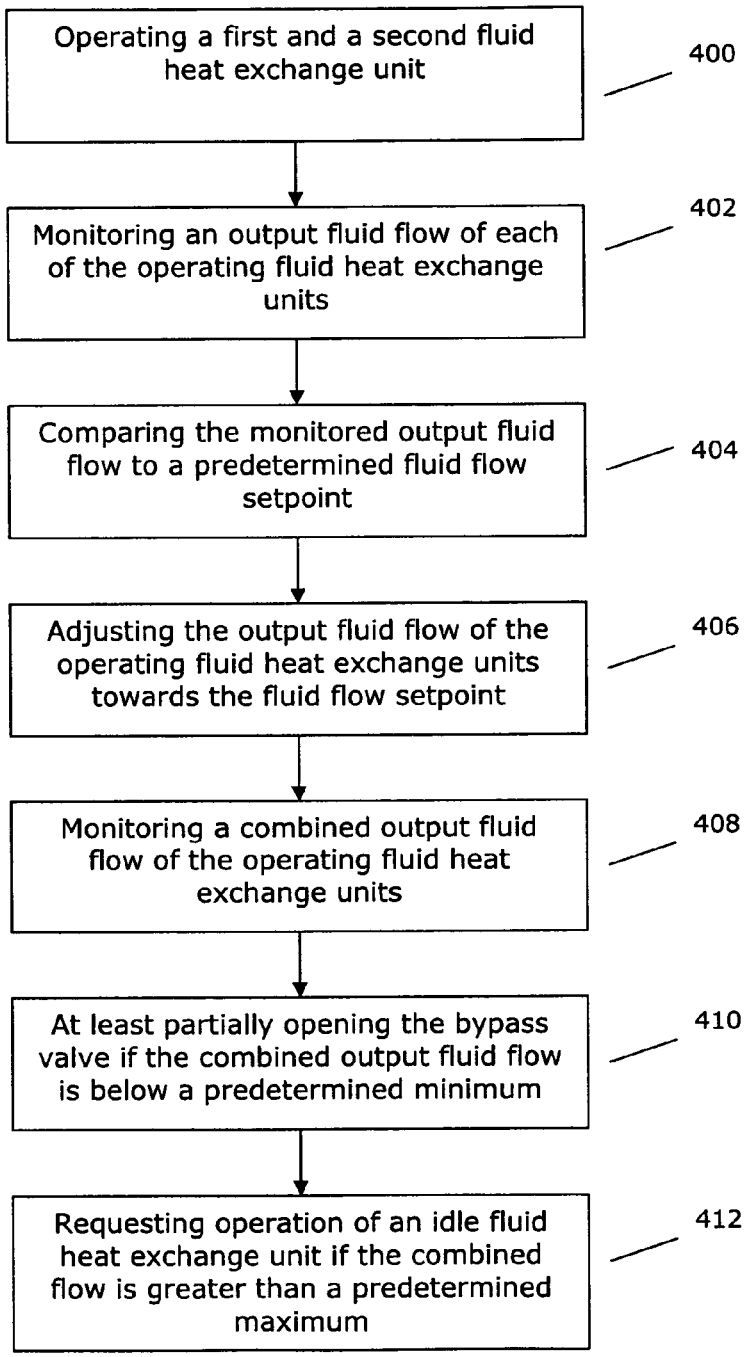
FIG. 4 is a flow diagram illustrating a method of controlling a hydronic system in accordance with an exemplary embodiment of the present invention.

FIG. 4 is a flow diagram illustrating a method of controlling a hydronic system. The hydronic system includes a plurality of fluid heat exchange units for feeding a load, and a bypass valve for bypassing the load. At step 400, at least a first and a second fluid heat exchange unit in the hydronic system are operated to heat or cool a fluid. An output fluid flow of each of the operating fluid heat exchange units is monitored at step 402. The monitored output fluid flow of each fluid heat exchange unit is compared to a predetermined fluid flow setpoint at step 404. The output fluid flow of each of the operating fluid heat exchange units is adjusted towards the predetermined fluid flow setpoint at step 406, if the monitored output flow is different from the predetermined fluid flow setpoint by at least a predetermined margin. A combined output fluid flow of the operating fluid heat exchange units is also monitored at step 408. The bypass valve is at least partially opened at step 410 if the combined output fluid flow is below a predetermined minimum combined output fluid flow. This step may also include determining when the combined output fluid flow has returned to a sufficient value such that the bypass valve may be closed. A request is made at step 412 to operate a previously idle fluid heat exchange unit if the combined output fluid flow is greater than a predetermined maximum combined output fluid flow for the number of operating fluid heat exchange units. Such a request may then be acted upon by starting the previously idle fluid heat exchange unit (either automatically or manually), or a decision may be made to not start the unit based on the operational scenario. Step 412 may also include requesting shutdown of a lag fluid heat exchange unit after determining that the remaining lead fluid heat exchange unit(s) will not experience a maximum flow alarm(s).

Although the present invention has primarily been described with respect to a hydronic system including chillers, it is not limited thereto. The present invention is applicable to any type of hydronic system, including any of a number of various types of heat exchange equipment (e.g., boilers).

Although the present invention has primarily been described with respect to a hydronic system including fluid heat exchange units for feeding a load, where the load includes a plurality of air handling units, it is not limited thereto. The present invention is applicable to any type of load fed by fluid heat exchange units in a hydronic system.

Although the present invention has primarily been described in terms of a three-pump, three-chiller system, it is not limited thereto. For example, the control system and control system logic may be applied to a hydronic system having any of a number of configurations.

Although the present invention has primarily been described in terms of a pump 101*a* being the lead pump, and chillIer 124*a* being the lead chiller, it is not limited thereto. Any of a number of pumps/chillers may be set-up as a lead or lag unit. Further still, a hydronic system according to present invention provides for each of the pumps to be able to be used as a lead or lag pump, and for each of the chillers to be able to be used as a lead or lag chiller.

Although the present invention has been described primarily in terms of a first fluid heat exchange unit being a lead unit, and a second fluid heat exchange unit being a lag unit, it is not limited thereto. The fluid heat exchange unit designated as the lead unit may be changed, either manually or automatically. As such, a fluid heat exchange unit that was previously a lag fluid heat exchange unit or an idle fluid heat exchange unit may be switched to be the lead fluid heat exchange unit, and vice-versa. Thus, the designations of lead and lag unit provided herein are only exemplary in nature.

Although the invention is illustrated and described herein with reference to specific embodiments, the invention is not intended to be limited to the details shown. Rather, various modifications may be made in the details within the scope and range of equivalents of the claims and without departing from the invention.

The invention claimed is:

1. A method of controlling a hydronic system, the hydronic system including a plurality of fluid heat exchange units for feeding a load, and a bypass valve for bypassing fluid flow from the load, the method comprising the steps of:

operating at least a first and a second fluid heat exchange unit in the hydronic system to heat or cool a fluid;

monitoring an output fluid flow of each of the operating fluid heat exchange units;

comparing the monitored output fluid flow to a predetermined fluid flow setpoint;

adjusting the output fluid flow of each of the operating fluid heat exchange units towards the predetermined fluid flow setpoint if the monitored output flow is different from the predetermined fluid flow setpoint by at least a predetermined margin;

monitoring a combined output fluid flow of the operating fluid heat exchange units;

at least partially opening the bypass valve if the combined output fluid flow is below a predetermined minimum combined output fluid flow; and operating a previously idle fluid heat exchange unit if the combined output fluid flow is greater than a predetermined maximum combined output fluid flow for the number of operating fluid heat exchange units.

2. The method of claim 1 further comprising the steps of:

measuring a temperature of a fluid flowing in a fluid header positioned downstream of the first and second fluid heat exchange units in the hydronic system; and comparing the temperature to a predetermined temperature.

3. The method of claim 1 wherein said adjusting step includes adjusting the output fluid flow of each of the operating fluid heat exchange units by varying the speed of a respective adjustable frequency drive, thereby driving the output fluid flow towards the predetermined fluid flow setpoint.

4. The method of claim 1 wherein said opening step includes at least partially opening the bypass valve repeatedly by incremental steps until the combined output fluid flow has reached the predetermined minimum combined output fluid flow.

5. The method of claim 1 further comprising the step of:

increasing a value of the predetermined minimum combined output fluid flow if the combined output fluid flow is below the predetermined minimum combined output fluid flow.

6. The method of claim 1 further comprising the step of:

opening the bypass valve to at least a partially open position such that stagnation of fluid in the hydronic system is substantially reduced.

7. The method of claim 1 wherein said step of monitoring an output fluid flow of each of the operating fluid heat exchange units includes using the combined output fluid flow, and an operating speed of each presently operating fluid heat exchange unit to determine the output fluid flow of each of the operating fluid heat exchange units.

8. The method of claim 1 wherein said step of monitoring an output fluid flow of each of the operating fluid heat exchange units includes dividing the combined output fluid flow by a number of presently operating fluid heat exchange units.

9. The method of claim 1 wherein said step of operating at least a first and a second fluid heat exchange unit includes operating the first fluid heat exchange unit at a constant flow and operating the second fluid heat exchange unit at a variable flow.

* * * * *